United States Patent [19]

Nagao et al.

[11] Patent Number: 4,696,340

[45] Date of Patent: Sep. 29, 1987

[54] AIR CONDITIONER

[75] Inventors: Teruyuki Nagao; Yuji Kawamura; Koichi Kashima, all of Konan, Japan

[73] Assignee: Diesel Kiki Co., Ltd., Tokyo, Japan

[21] Appl. No.: 882,529

[22] Filed: Jul. 7, 1986

[30] Foreign Application Priority Data

Jul. 8, 1985 [JP] Japan ..... 60-149625

[51] Int. Cl.[4] ..... F25B 29/00

[52] U.S. Cl. ..... 165/58; 62/325; 62/408

[58] Field of Search ..... 236/13; 62/408–411, 62/325; 98/31.6; 165/96, 58

[56] References Cited

U.S. PATENT DOCUMENTS

| | | | |
|---|---|---|---|
| 2,290,985 | 7/1942 | McElgin | 236/13 X |
| 3,517,527 | 6/1970 | Bouchat | 62/325 |
| 3,613,776 | 10/1971 | Loveley | 98/31.6 X |
| 3,650,318 | 3/1972 | Avery | 236/13 X |
| 4,377,201 | 3/1983 | Kruse et al. | 165/96 |
| 4,449,570 | 5/1984 | Locker | 62/408 X |

*Primary Examiner*—William E. Tapolcai

*Attorney, Agent, or Firm*—Wenderoth, Lind & Ponack

[57] ABSTRACT

An air conditioner comprises an outer casing containing an inner casing having a heat exchanger disposed therein and a blower so as to define jointly with the inner casing an internal air intake passage. The air conditioner further includes an air intake-discharge selector mechanism disposed in a desired position in communication with the air intake passage for taking air into and out of the air conditioner.

5 Claims, 6 Drawing Figures

AIR CONDITIONER

BACKGROUND OF THE INVENTION

1. Field of the Invention

The present invention relates to an air conditioner adapted to be installed in a building or a housing.

2. Prior Art

A conventional air conditioner disclosed in Japanese Utility Model Publication No. 44-29503 comprises a heat exchanger and a blower disposed in a casing or housing. Room air is introduced from a lower inlet into the casing for temperature control and the temperature-controlled air is blown from an upper outlet into the room interior. The airflow passage in the casing extends only in one direction so that the inlet must be disposed below the outlet.

With this construction, the air conditioner must be installed in a predetermined posture, i.e. an air conditioner having a construction for vertical installation cannot be installed in a horizontal posture or orientation. When the installation site has a space insufficient for vertical installation of such air conditioner, it becomes necessary to provide another air conditioner constructed to be suitable for horizontal installation thereof.

SUMMARY OF THE INVENTION

It is accordingly an object of the present invention to provide an air conditioner having versatility in respect to installation.

A more specific object of the present invention is to provide an air conditioner having structural features which enable the air conditioner to be installed in both vertical and horizontal postures without substantial reconstruction.

Another object of the present invention is to provide an air conditioner having inner and outer casings defining therebetween internal air intake passages having relatively large cross-sectional areas, respectively, thereby allowing air to flow therethrough at a low velocity.

A further object of the present invention is to provide an air conditioner capable of blowing conditioned air without causing unpleasant noise.

According to the present invention, the foregoing and other objects are attained by an air conditioner comprising an inner casing housing a heat exchanger therein, a blower disposed at one side of the casing and having a discharge hole connected with an air intake-discharge selector mechanism, an outer casing housing the inner casing and the blower therein so as to define jointly with the inner casing an internal air intake passage, the air intake passage being connected with the air intake-discharge selector mechanism.

With this construction, it is possible to dispose the air intake-discharge selector mechanism at any position, enabling the air conditioner to be installed either in a vertical posture or in a horizontal posture. Thus the air conditioner has a versatility in installation which facilitates adaptability in the installation of the air conditioner at a site having space limitations or restrictions.

Many other advantages, features and other objects of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION OF THE PREFERRED EMBODIMENT

Figure 2:
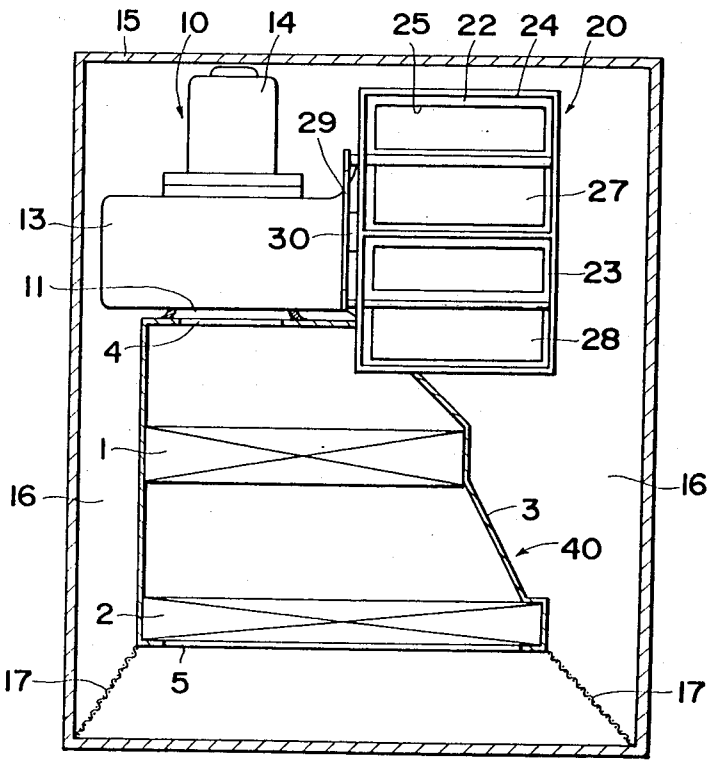
FIG. 2 is a view similar to FIG. 1, showing the air conditioner viewed from a different direction.
Figure 1:
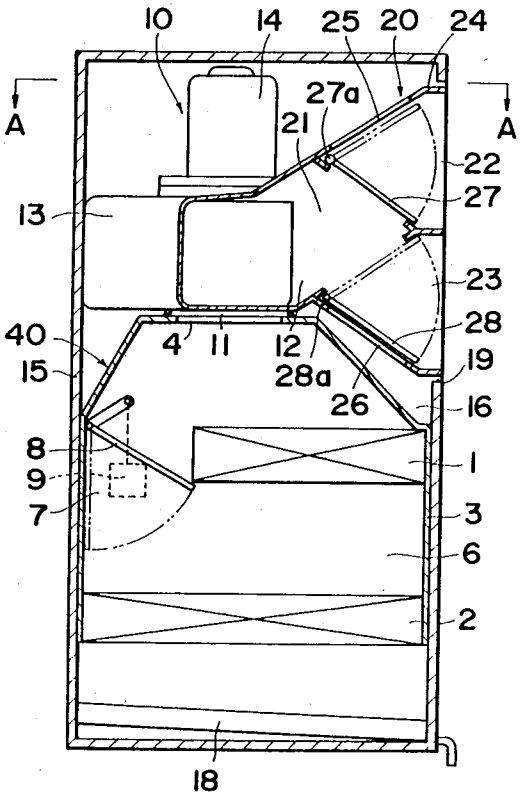
FIG. 1 is a vertical cross-sectional view of an air conditioner according to the present invention.
Figure 3:
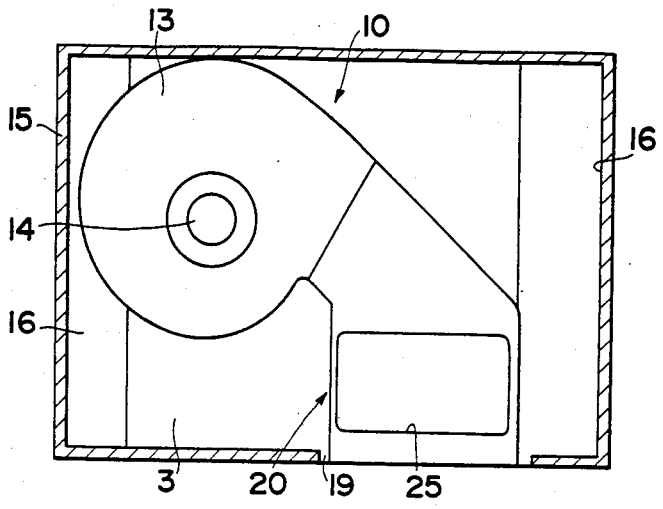
FIG. 3 is a cross-sectional view taken along line A—A of FIG. 1.

As shown in FIGS. 1 to 3, an air conditioner constructed in accordance with the present invention comprises an inner unit 40 having a heat exchanger 1 for heating, a heat exchanger 2 for cooling and an air-mix door 8, all the components 1, 2, 8 being disposed in an inner casing 3 of the inner unit 40. In the illustrated embodiment, the heat exchanger 1 is disposed above the heat exchanger 2.

The heat exchanger 1 receives circulating hot water for heating air as the latter passes through the heat exchanger 1. The heat exchanger 2 comprises an evaporator of a refrigeration system for cooling air as the latter passes through the heat exchanger 2.

The inner casing 3 has, at one of its opposite ends, an outlet 4 communicating with an intake hole 11 of a blower 10 and, at the other end, an inlet 5 which is substantially larger than the outlet 4. The inner casing 3 is fixed to an outer casing 15 at portions of the periphery of the inlet 5. The inner casing 3 includes therein a main airflow passage 6 extending upwardly from the inlet 5 to the outlet 4 through the heat exchangers 2, 1. The inner casing 3 further includes a bypass passage 7 extending around the heat exchanger 1 to bypass the same. The air-mix door 8 is disposed in the bypass passage 7 and is angularly movable to adjust the ratio of the amount of cooled air to the amount of heated air for controlling air temperature at a desired value. The air-mix door 8 is actuated by a motor actuator 9 driven in response to outputs from a control device or a manual temperature control lever (neither shown).

The blower 10 includes a blower casing 13 having the intake hole 11 and a discharge hole 12, a fan (not shown) movably disposed in the blower casing 13, and a drive motor 14 mounted on the casing 13 and coupled with the fan to rotate the latter. When the drive motor 14 is driven, air is drawn from the inner casing 3 through the outlet 4 and the intake hole 11 into the blower casing 13 and then is discharged from the discharge hole 12. The blower 10 is disposed above the inner casing 3 and is connected at an discharge side thereof with a air intake-discharge selector mechanism 20.

The outer casing 15 has a hollow rectangular body and houses therein the inner casing 3 and the blower 10. The outer casing 15, as shown in FIGS. 1 and 3, contacts the inner casing 3 at a pair of opposed inner faces thereof for supporting the inner casing 3. The other pair of opposed inner faces of the outer casing 15 are separated from the inner casing 3 so that a U-shape internal air intake passage 16 is defined between the inner and outer casings 3, 15. The U-shaped internal air intake passage 16 communicates at its opposite ends thereof with the inlet 5 of the inner casing 3 which is open toward a lower end of the outer casing 15. Thus, air in the air intake passage 16 flows into the inner casing 3 through the inlet 5.

A pair of filters 17 extends diagonally between opposite lower corner edges of the inner casing 3 and opposed lower corner edges of the outer casing 15 for filtrating air passing therethrough. A drain pan 18 is disposed in the outer casing 15 at a lower end thereof for collecting condensed water.

The air intake-discharge selector mechanism 20 is comprised of a funnel-shaped selector duct or case 24 having an inner connecting opening 21 connected with the discharge hole 12 of the blower 10, and a pair of upper and lower outer openings 22, 23 communicating with the inner connecting opening 21 and facing the outside of the outer casing 15. The selector case 24 is formed integrally with the blower case 13.

The outer openings 22, 23 having a rectangular shape, are disposed one above another, and are fitted in an aperture 19 provided in the outer casing 15.

The selector case 24 of the air intake-discharge selector mechanism 20 further includes a pair of connecting passages 25, 26 through which the air intake passage 16 communicates with the interior of the selector case 24, and a pair of shutters 27, 28 pivotably mounted on respective support shafts *27a, 28a* secured to the selector case adjacent to the inner connecting opening 21. The shutter 27 is movable between a first position indicated by phantom lines at which the connecting passage 25 is closed by the shutter 27 and the inner and outer openings 21, 22 communicate with each other, and a second position indicated by solid lines, at which the connecting passage 25 is open to and communicates with the outer opening 22. The shutter 28 is also movable between first and second positions indicated by phantom lines and solid lines, respectively. When the shutter 28 is in the first position, the connecting passages 26 is open to and in communication with the outer opening 23. Alternately when the shutter 28 is held in the second position, the connecting passage 26 is closed and the inner and outer openings 21, 23 communicate with each other.

The shutters 27, 28 are coupled with a lever 29 for synchronizing the angular movement of the shutters and are driven by a motor actuator 30. With the air intake-discharge selector mechanism 20 thus constructed, the discharge hole 12 of the blower 10 is connected with a selected one of the outer openings 22, 23 in response to pivotal movement of the shutters 27, 28. At the same time, the other opening 22 or 23 is in communication with the corresponding connecting passage 25 or 26.

Operation of the air conditioner is described below with reference to two operation modes respectively shown in FIGS. 4 and 5.

Figure 4:
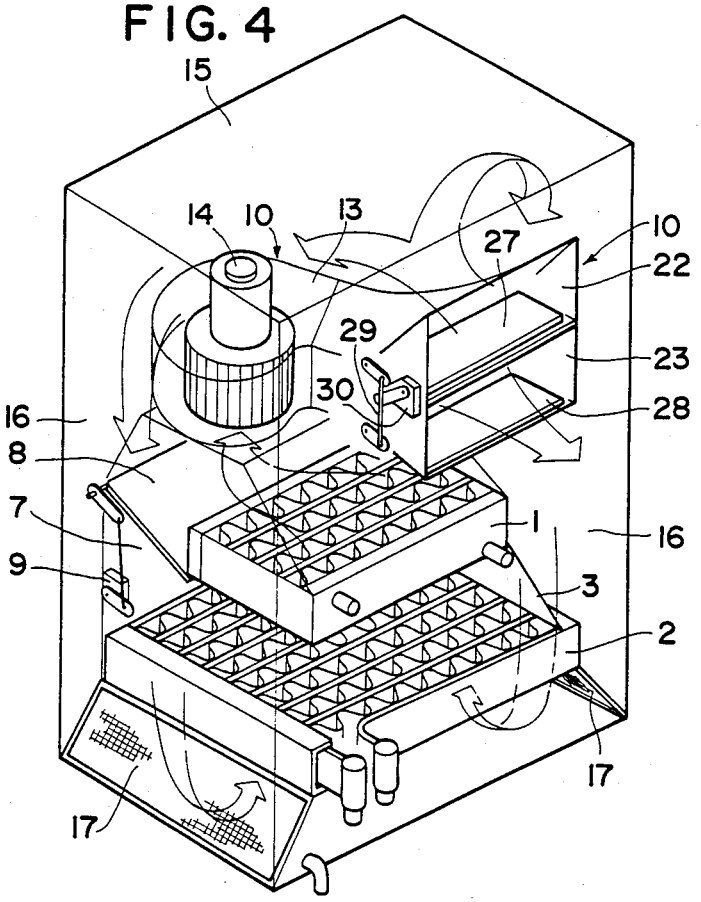
FIG. 4 is a schematic perspective view of the air conditioner illustrating airflow when the air conditioner is in a heating operation mode.

FIG. 4 shows the air conditioner functioning as a heater. In this operation mode, the shutters 27, 28 are held in the respective solid line positions of FIG. 1 so that heated air is blown from the lower outer opening 23 into the room interior. Room air is drawn into the air conditioner from the upper opening 22, which in turn enters the air intake passage 16 through the connecting passage 25, then flows downwardly along the inner casing 3, thereafter passes through the filters 17, and enters the inner casing 3 from the inlet 5. In the inner casing 3, the air flows upwardly through the heat exchanger 2 (not operated in the heating operation mode) and through the heat exchanger 1 during which time the air is subjected to a heat-exchange relationship with the hot water circulating through the heat exchanger 1.

The air thus heated is then drawn into the blower 10 through the outlet 4 and the intake hole 11, and thereafter is forced from the discharge hole 12 into the room interior through the inner and outer openings 21, 23 of the selector-mechanism 20. The temperature of the blown-off air is regulated by varying the angular position of the air-mix door 8.

Figure 5:
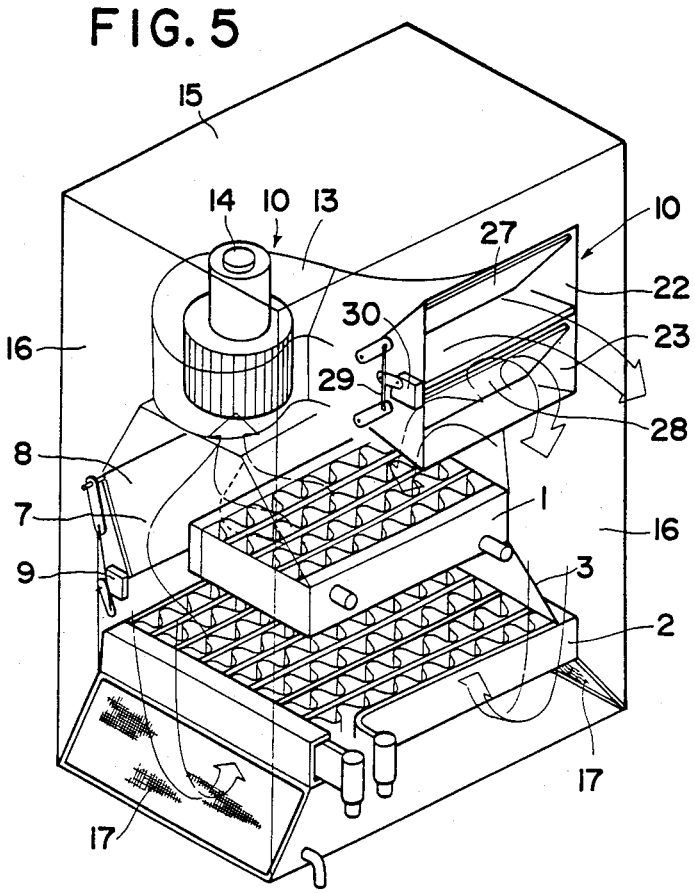
FIG. 5 is a view silimar to FIG. 4, showing airflow when the air conditioner is in a cooling operation mode.

The air conditioner shown in FIG. 5 is functioning as an air cooler. In this operation mode, the shutters 27, 28 are held in the phantom line position of FIG. 1 so that cooled air is blown from the upper outer opening into the room interior. Room air is drawn from the lower opening 23 into the air conditioner, which in turn enters the air intake passage 16 through the connector passage 26, then flows downwardly along the inner casing 3, thereafter passes through the filters 17, and enters the inner casing 3 from the inlet 5 thereof. In the inner casing 3, the air flows upwardly through the heat exchanger 2 where it is cooled. The cooled air further flows upwardly through the heat exchanger 1 (operated, if necessary, even in the cooling operation mode) and then is drawn from the intake hole 11 into the blower 10 through the outlet 4. The cooled air is then forced from the blower 10 into the room interior through the discharge hole 12 and the inner and outer openings 21, 22 of the selector mechanism 20.

To control the temperature of the blown-off air, the air-mix door 8 is turned to a desired angular position to regulate the amount of air passing through the heat exchanger 1.

Figure 6:
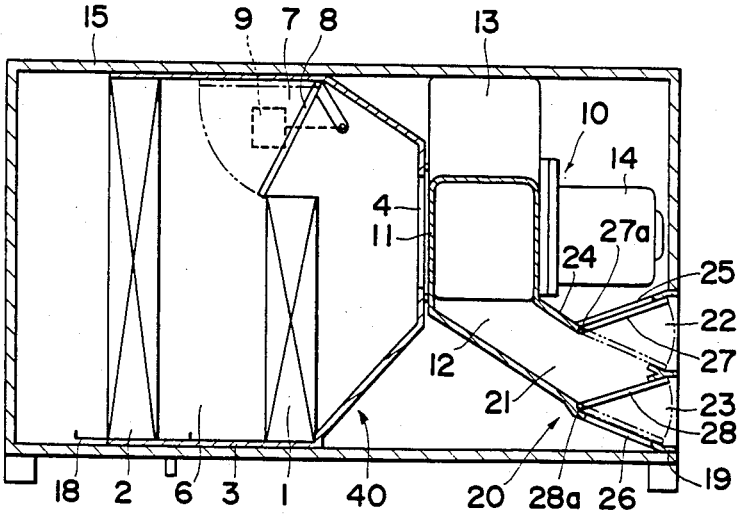
FIG. 6 is a cross-sectional view of an air conditioner according to another embodiment of the present invention.

FIG. 6 shows a modified air conditioner constructed for horizontal installation. This air conditioner is structurally and functionally the same as the air conditioner shown in FIGS. 1–5 with the exception that the air intake-discharge selector mechanism 20 is located in a different position. With this structural similarity, the same or corresponding parts are designated by the same reference characters and a detailed description is not necessary.

By providing two air intake-discharge selector mechanisms constructed exclusively for vertical and horizontal installation, respectively, an air conditioner can be installed in both vertical and horizontal postures without substantial reconstruction thereof.

Although in the illustrated embodiments, two heat exchangers 1, 2 are employed for controlling the air temperature, only one heat exchanger is necessary when the air conditioner is equipped with a heat pump. Furthermore, the air-mix door 8 may be replaced with any other suitable temperature control mechanism.

Obviously, many modifications and variations of the present invention are possible in the light of the above teachings. It is therefore to be understood that within the scope of the appended claims, the invention may be practiced otherwise than as specifically described.

What is claimed is:

1. An air conditioner comprising:

an outer casing;

an inner casing mounted within said outer casing and spaced therewithin from said outer casing for defining an internal air intake passage between said inner casing and said outer casing; said inner casing having an inlet open to and communicating with said internal air intake passage, and said inner casing having an outlet;

at least one heat exchanger mounted within said inner casing between said inlet and said outlet thereof;

blower means having an intake hole open to and communicating with said outlet of said inner casing and a discharge hole, said blower means for drawing air thereto from said inner casing through said outlet of said inner casing and for forcing the air drawn thereto out of said discharge hole; and an air intake-discharge selector mechanism within said outer casing for placing said discharge hole of the blower means in communication with the outside of the air conditioner while placing the outside of the air conditioner in communication with said internal air intake passage, said air intake-discharge selector mechanism including a pair of outer openings extending through said outer casing thereby open to and communicating with the outside of the air conditioner, a pair of connecting passages each of which is open between a respective one of said outer openings and said internal air intake passage, a pair of shutters each of which is movably mounted over a respective one of said connecting passages for moving over and away from said connecting passages to respectively close and open said connecting passages thereby selectively communicating said outer openings with said internal air intake passage, and synchronizing means for moving one of said pair of shutters over the respective connecting passage thereof as the other of said pair of shutters moves away from the respective connecting passage thereof.

2. An air conditioner as claimed in claim 1, wherein said at least one heat exchanger comprises a first heat exchanger for heating the air drawn through said inner casing by said blower means, and a second heat exchanger for cooling the air drawn through said inner casing by said blower means.

3. An air conditioner as claimed in claim 2, wherein said inner casing has a main airflow passage defined therein between said inlet and said outlet and through which the air is drawn by said blower means;

said first heat exchanger is disposed within the inner casing in said main airflow passage;

said inner casing has a bypass passage extending around said first heat exchanger and therebetween and through which air drawn by said blower means bypasses said first heat exchanger; and an air-mix door movably mounted in said bypass passage for opening and closing said bypass passage.

4. An air conditioner as claimed in claim 1, wherein said internal casing has two opposed side faces and said outer casing has two opposed side faces, said two opposed side faces of said inner casing contacting said two opposed side faces of said outer casing respectively at respective inner surfaces thereof.

5. An air conditioner as claimed in claim 1, and further comprising a filter extending between said inner casing and said outer casing.

* * * * *